US006776416B1

(12) United States Patent
Jackson

(10) Patent No.: US 6,776,416 B1
(45) Date of Patent: Aug. 17, 2004

(54) NO-BUST BLACKJACK-TYPE GAME

(76) Inventor: Kathleen Nylund Jackson, 51 Williamsburg La., Scituate, MA (US) 02066

( * ) Notice: Subject to any disclaimer, the term of this patent is extended or adjusted under 35 U.S.C. 154(b) by 0 days.

(21) Appl. No.: 10/360,089

(22) Filed: Feb. 7, 2003

(51) Int. Cl.[7] ..... A63F 1/00

(52) U.S. Cl. ..... 273/292; 273/138; 273/139; 273/303

(58) Field of Search ..... 273/292, 138, 273/139, 303

(56) References Cited

U.S. PATENT DOCUMENTS

| | | | | | |
|---|---|---|---|---|---|
| 4,861,041 | A | | 8/1989 | Jones et al. | 273/292 |
| 5,174,579 | A | | 12/1992 | Griffiths | 273/292 |
| 5,275,416 | A | | 1/1994 | Schorr et al. | 273/292 |
| 5,397,128 | A | * | 3/1995 | Hesse et al. | 273/292 |
| 5,454,570 | A | | 10/1995 | Karal | 273/292 |
| 5,615,888 | A | * | 4/1997 | Lofink et al. | 273/292 |
| 5,743,530 | A | * | 4/1998 | Sklad et al. | 273/274 |
| 5,816,575 | A | | 10/1998 | Keller | 273/292 |
| 5,839,730 | A | | 11/1998 | Pike | 273/292 |
| 5,979,897 | A | * | 11/1999 | Grossman | 273/292 |
| 6,012,719 | A | | 1/2000 | Webb | 273/292 |
| 6,027,118 | A | | 2/2000 | Aramapakul et al. | 273/274 |
| 6,179,828 | B1 | | 1/2001 | Mottola et al. | 604/523 |
| 6,275,415 | B1 | | 8/2001 | Haddad et al. | 365/185.11 |
| 6,296,251 | B1 | | 10/2001 | Webb | 273/292 |
| 6,341,778 | B1 | | 1/2002 | Lee | 273/292 |
| 6,422,565 | B1 | * | 7/2002 | Daines | 273/292 |
| 6,491,301 | B1 | | 12/2002 | Webb | 273/274 |

* cited by examiner

*Primary Examiner*—Derris H. Banks
*Assistant Examiner*—Dolores R. Collins
(74) *Attorney, Agent, or Firm*—Mark A. Litman & Associates, P.A.

(57) ABSTRACT

A wagering game is played with one or more standard decks of playing cards. Each deck comprises a) 52 cards or b) 48 cards without 10's. The method comprises: each player placing at least one wager to play in the game against a dealer; each player receiving two initial cards and the dealer receiving two initial cards; each player exercising optional rights to take additional cards, (hits) until the player stands with a point count of 21 or below, or each player exercising optional rights to take additional cards until a point count in a player's hand exceeds a point count of 21, the player's hand remaining in-play even after a point count in excess of 21 is obtained; and the dealer taking hits according to conventional rules of blackjack so that the dealer total count according to the rules reaches at least a soft 17, at least a hard 17, or a count in excess of 21; wherein, if both the player's hand and the dealer's hand exceed a point count total in excess of 21, rules determine whether the player's hand wins, ties or loses against the dealer's hand. Hands of 21 or under always wins over a bust hand. In ties of point counts of 21 and/or below, either convention rules or special rules determine whether the dealer wins or ties the player's hand. In addition, the player may receive in excess of 3:2 for a blackjack.

20 Claims, No Drawings

NO-BUST BLACKJACK-TYPE GAME

BACKGROUND OF THE INVENTION

1. Field of the Invention

This invention relates to casino table games and particularly to variations in the play of Blackjack or Twenty-One type games.

2. Background of the Art

Card games have always been popular as wagering games. The history of card games reaches back into biblical eras. One of the most popular card games, especially for gambling or gaming uses is the card game known as Blackjack (or "21") wherein a blackjack player plays against a dealer and the object is to beat the dealer's hand by reaching a total point value closest to 21, without exceeding a point count of twenty-one and/or by having the dealer's point count exceed twenty-one. The player may exercise strategies including adjusting his point count either by maintaining his original cards and card count (e.g., referred to as "standing," not drawing a card that might cause the Blackjack player to 'bust, that is go over 21) and hope that the dealer will bust or by accepting additional cards (referred to as 'hitting' or 'taking a hit'), attempting to receive a cumulative point card total higher (not exceeding a total point count of 21) than the total point count that the Dealer will ultimately attain. If both the Blackjack player and the dealer each achieve a point count total that does not exceed 21, then the highest total (as between individual players and the dealer) wins the bet. Blackjack is relatively simple to understand and is usually a faster and easier card game to play than, for example, the game of Poker, therefore Blackjack, which can be played with the dealer and only one Blackjack player, tends to be more popular than the conventional game of Poker which needs to be played with several players because each of the Poker players are competing against each other for one pot whereas each Blackjack player can win against the one dealer. Even with variants of poker being played in casinos (e.g., Let It Ride® poker, Three Card Poker®, Crazy 4 Poker™, Caribbean Stud® poker, etc.), Blackjack remains the most popular card game in casinos, with many more tables usually dedicated to blackjack than to all other card games combined.

Blackjack must include a dealer (in mechanical, electromechanical, electronic or video versions of the game, a virtual dealer's hand is provided) and there must be at least one Blackjack player. One or more Blackjack players playing against the Dealer are, in effect, individually competing to try to either obtain a better total card point count than the point count of the dealer, without exceeding a total point count in the player's hand of 21 (for the total number of multiple playing cards that they the dealer is dealt). The player may stand after receiving a minimum of 2 cards and hope that the Dealer will bust. There are many variants on strategies that are used in the play of cards that are dependent upon a consideration of the player's cards in comparison with the dealer's cards. There are preferred and optimal strategies that may be used, with some strategies possibly influenced by card counting by the player.

For example, Blackjack players seeing a dealer's exposed card as a 2, 3, 4, 5 or 6, will themselves elect to take no hits when the player's point count is 12, 13, 14, 15 or 16 in the hopes that the dealer's hitting (which is required when the dealer's point count is 16 or less) will result in a bust. The objective of the player is that with the exposed card being generally incapable of having a starting point count where the dealer may stand (the exception being a disclosed card of a 6 and a hole card of an ace), the dealer will take hits to a point total that exceeds 21 and therefore break (or "bust"), allowing the player to win the hand. The player will win the bet if the dealer has to hit (the Dealer is required to draw if their point total is 16 or less) and the Dealer busts (goes over 21). Blackjack players also have the option of splitting any pairs (i.e., a pair of cards of identical point count value, such as two face cards, a 10 and a face card, a pair of 10s, a pair of 9s, a pair of 3's, etc.). Blackjack players have several options such as to double down (double their bet and receive only one more card), double their bet when they split a pair of cards, and can receive a 1.5 times their bet return if they receive an Ace and a 10 or picture card for their other card. A Blackjack player receiving a card score of more than 21 points has a bust hand and automatically loses to the dealer. If the dealer accumulates cards with a point count in excess of 21, the dealer busts, and every player remaining in the game (those players who have not busted themselves) wins the hand. The dealer, after receiving the first 2 cards begins drawing one or more cards (if the first 2 cards are 16 or less), but only after each of the Blackjack players at the dealer's table have played their hands to completion. Therefore, the house or casino has the advantage because the Blackjack player or players must play and complete their hand first or before the dealer plays or completes his hand. The Blackjack players at the table individually play against the dealer. The dealer must receive a minimum of 2 cards and attain a point count of at least 17 before the dealer may stop taking cards. Each of the Blackjack players individually playing against the dealer (who is a representative of the house or casino) has the option of standing after the receipt of their 2 initial cards. This means that the player will have the options of not receiving any other cards or to draw one or more other cards from the dealer and to continue drawing cards until the player is either satisfied with their card count score and stops drawing cards (stands) or the player has busted (gone over the 21 point total). As is known in the Blackjack card game, picture cards (Jacks, Queens and Kings) each have a point card value of 10 points while Aces have a point card value of either 1 point or 11 points. The other cards namely 2s, 3s, 4s, 5s, 6s, 7s, 8s, 9s and 10s have a point card value equivalent to their face card value (i.e., respectively 2, 3, 4, 5, 6, 7, 8, 9, and 10). In most gaming or casino establishments, dealers have to draw when they receive a point card value of 16 or less and, in some Casinos or gaming establishments, when they receive a point card value of 17 or less where the 17 point card value is based upon using an Ace as an 11 point card value with one or more other cards (this is known as a soft 17).

While Blackjack or 21 is a relatively fast-playing popular card game, it is always desirable to offer the players opportunities for variations in the game to maintain their long-term interest. Other betting options are desirable for the Blackjack player other than just varying the size of their wagers. Thus a Blackjack game is needed which would permit the Blackjack player to have a chance to win a large bet (as a regular option or an option after losing a number of conventional bets to the dealer) without the risk of losing a large bet that was the only previous option to try to promptly recoup a series of lost bets to the Dealer.

Attempts have been made to vary the game of Blackjack to a relatively minor degree wherein a Blackjack player could have more than one betting option other than the Blackjack player's bet to receive a higher card total not more than the maximum of 21 than the Dealer or to hope that the Dealer busts. However, these other attempts have not been successful because they do not provide a multitude of very exciting betting options combined with a large jackpot type of payout. U.S. Pat. No. 5,454,570 to Karal discloses a Blackjack card game method therein a Blackjack player has extended wagering opportunities after the Blackjack player's hand has reached a desired card count value. Specifically, the Blackjack player can bet on whether the Dealer will achieve a card count that would be higher (but not greater than 21) than the Blackjack player's hand. This supplemental bet or wager by the Blackjack player is prior to the Dealer revealing the Dealer's face down card. Predetermined odds on the different possible Dealer hand combinations are selected by the Blackjack player by the selection of the point card value of the Dealer's hand. Also, the Blackjack player can wager on the point card value of the Dealer's only face down card. Furthermore, the Blackjack player can bet on the point card value of the third Dealer card, etc. The odds presented in this U.S. Patent range from 10 to 1 (on an Ace being the Dealer down card or the next card to be drawn by the Dealer). Picture cards including 10s have a 2 to 1 betting ratio.

U.S. Pat. No. 5,275,416 to Schorr et al. also discloses a Blackjack card game method wherein a Blackjack player can bet on the Dealer's hand, the Blackjack player's hand or for a tie in the point count between the Dealer and the Blackjack player. The bet for the tie pays 9 to 1, the bet for the Blackjack player's hand is even money (1 for 1), and the bet on the Dealer's hand is 5 for 6 (five chips can be won on a 6 chip bet).

U.S. Pat. No. 5,174,579 to Griffiths discloses a Blackjack card game method wherein a separate bet can be made on whether the dealer obtains exactly 21 or busts. Disclosed therein is a discussion of Royal Match 21 involving a separate bet by the Blackjack player to have their 2 initial cards be of the same suit (i.e. clubs, diamonds, hearts and spades). A higher payout is for when the Ace and King is received by the Blackjack player in the same suit for the 2 initial cards, but there is no separate bet for the receipt of these two cards (only a payout if they happen to be received when a bet is made for the receipt of 2 initial cards of the same suit). Also disclosed therein is a reference to the U.S. Pat. No. 4,861,041 to Jones et al. wherein a separate bet on a blackjack game is made to be eligible for certain specific jackpot hands (i.e., four 5s and an Ace or Ace, Two, Three, Four, Five and Six). Simply stated, prior attempts at providing more than one betting option to the Blackjack player did not give the Blackjack player an opportunity to bet and win a very large bonus (i.e. more than a thousand chips for each chip bet) as well as to bet on many different possible combinations that would pay more than a one chip payback for each one chip bet, but yet still provide the Blackjack player with, if desired, a straight bet to beat the dealer.

Some games have been developed where different payouts are provided when the differentials between a player's hand and a dealer's hand are within particular limits or ranges (without breaking) as in U.S. Pat. Nos. 6,296,251; 6,491,301; and 6,341,778.

U.S. Pat. No. 5,816,575 describes a variant of Blackjack (21) game, in which a table and method is disclosed wherein a number of betting options are provided for the Blackjack player. In addition to the standard betting option against the dealer, a dealer Bust option, a jackpot option where the Blackjack player can obtain over 1,000 to 1 return payout and several other betting options are provided to bet on various possible cards such as receiving a 3 or a 6, a 4 or 5, a 10, Jack Queen, King or Ace for one or both of the initial two cards. The method of playing Blackjack against a dealer comprises the steps of providing a Blackjack player with a jackpot betting option to make a bet and have a possibility of winning more than one thousand times the bet made by the Blackjack player; and providing the Blackjack player with additional separate betting options to make a bet on receiving at least one card from an initial two cards received by the Blackjack player equal to one of a 4 and 5, one of a 3 and 6 and a selected one of a 10, a Jack, a Queen, a King and an Ace.

U.S. Pat. No. 5,839,730 describes a method for a wagering game is achieved by providing a side bet opportunity during the play of a Twenty-One game. The player is given the opportunity to place this side bet with the hope of receiving winnings when certain predetermined card configurations are received. Upon receipt of these defined card configurations, the player is immediately paid winnings during the process of the Twenty-One game. These additional winnings are based on sequences of cards and are independent and separate from wagers in the Twenty-One game. Additionally, all of the predetermined card configurations are preferably chosen such that they will not interfere with the underlying Twenty-One game. As a basis for paying out winnings, it is required that the player consecutively receive these certain card configurations during the play of the Twenty-One game after having made a bet in expectation of those card configurations appearing. Also, the final configuration of the Twenty-One hand is irrelevant to the side bet game as the players win immediately when the predetermined configurations are received, long before completion of the hand. In particular, the player's receiving of identical value cards in sequence is awarded bonus amounts when a side wager is placed.

U.S. Pat. No. 6,012,719 describes a card game that combines the play of Blackjack ("21") with a 3-card Poker wager or side bet ("21+3"). Each player places a basic Blackjack wager and an optional 3-card Poker wager before the cards are dealt. Each player is then dealt a card with the dealer receiving a face-up card. Each player is dealt a second card. At this point, the outcome of each 3-card Poker hand is determined, where a player's 3-card Poker hand consists of the 2-card hand dealt to that player and the dealer's face-up card. After settling the Poker wagers, the game of Blackjack continues in a typical fashion. The invention advantageously retains all the features and advantages of Blackjack as well as provides the dynamics of 3-card Poker, without interfering with the card sequence, for enhanced player anticipation and enjoyment.

Over-Under 13 is a side bet game in which a player may place an "over 13" or an "under 13" side bet on a blackjack hand. The player may bet that the player will have an initial two card hand under or over the point count of 13. This side bet game is widely used in casinos in the United States.

D.E.Q. Casinos, Ltd. markets a game known as "Luck Jacks & Queens™" which is played in conjunction with a side bet in a standard blackjack game. Regular blackjack rules apply, and an optional side bet for the side game is made. Combinations of a Jack and a Queen on the first two cards win a randomly selected prize amount. Suited Queen and Jack combinations on the first two cards can win multiples of the randomly selected prize amounts. The random amount is selected and displayed on a meter attached to the table. There is no pay table.

One of the features of Blackjack that greatly affects the ability of the house to win and the enjoyment of the player is the fact that players take hits first and may bust or break before the dealer has had to take any cards. This is a significant advantage to the house and is not an element of the game that provides a favorable anticipation for the player. A number of described Blackjack games have attempted to adjust this aspect of play in ways that are intended to increase the players' enjoyment of the game and increase the players' ability to win.

U.S. Pat. No. 6,275,415 describes a card game and method of playing the same played with a fifty six card deck and played to a predetermined unique point total on a table having a playing surface and several player stations surrounding said table and a card dealer station located between two of the players, and said dealer does not play hands, in which each station where a player is located initially receives two cards face down with the player adding the value of said cards and each player in rotation to receive one or more cards face up or to stand on the original cards in an endeavor to reach the point total, each player playing against the other of said players and a winning player having the point total or a total less than or greater than said point total.

U.S. Pat. No. 6,027,118 describes a method of playing a Blackjack-type wagering game (20) includes a player playing against a player-banker wherein the object of the game is to reach a numerical total of 20. The winner is (a) the player who has the largest numerical total which does not exceed 20, or if both players' totals exceed 20, (2) the player who's numerical total is closest to 20. A "natural" is defined as either two kings, two queens, two jacks, or two tens on the first two cards. In one embodiment, hands which exceed a numerical total of 20 are ranked by the high card which they contain, rather than by their proximity to 20. Game (20) can either be played as a banking or non-banking game. This game penalizes normal blackjacks, may remove the 3:2 payoff for naturals (as the occurrence of two similarly faced 10-value cards is greater than the occurrence frequency of blackjacks).

U.S. Pat. No. 6,422,565 describes a method of playing a game of cards between a dealer and a player, comprising the steps of: (a) providing at least one standard deck of cards; (b) allowing the player to place a bet; (c) dealing two cards face up to the player and one card face up to the dealer; (d) paying the player's bet if the player's two cards are a blackjack; (e) dealing additional cards to the player, at the player's option, until the player does not want any more cards or until the player's hand exceeds 21; (f) collecting the player's bet if the player's hand exceeds 21; (g) after the player stands, dealing additional cards to the dealer until the dealer's hand either exceeds the player's hand or exceeds 21; and (h) collecting the player's bet if the dealer exceeds the player's hand but not 21; or paying the player's bet if the dealer exceeds 21.

U.S. Pat. No. 6,179,828 describes A variation of blackjack is played with a standard deck of cards that is augmented by two jokers. A hand that includes the two jokers is called a natural. The natural outranks all other hands. A hand that includes one joker has a total point value of "21". The player is permitted to hit, double-down, surrender or split a pair unless a face-up card of the dealer is a joker.

In spite of the success of some of these card games, there is always a need to provide additional alternative for players.

BRIEF DESCRIPTION OF THE INVENTION

A method of playing a casino table Blackjack-type game or video version of a standard Blackjack-Type game uses a standard deck of playing cards (without Jokers, special cards or special wild cards) or with a Spanish Twenty-One® blackjack deck. The game is a no-bust blackjack game in that play of the game will continue even if the player breaks while taking hits in advance of the dealer taking conventional hits. When both the player and the dealer hands exceed a count of 21, the hand closest to 21 wins the hand.

DETAILED DESCRIPTION OF THE INVENTION

A game is played according to the standard format of Blackjack with an additional set of rules. The game should be played with a standard playing card deck (52 cards) or multiples of standard playing cards (that is X times 52), although it may also be played with a Spanish Twenty-One® blackjack game deck, with the 10's removed. The significant change or addition in the rules relates to the play of the game with respect to events where the player and/or the dealer hand exceed a count of 21. A combination or variety of combination of rules is highly desirable to balance the effect of the rule changes on the house hold and the player's likelihood of winning. By balancing the rules, the game remains attractive to both the house and the player, usually with the house hold remaining between 0.25% and 6%.

The basic play of the game follows the general rules of Twenty-One, except that the player does not automatically lose his bet if said player's total goes over 21. If the player hits or doubles down and the total is more than 21, the player keeps his cards (for example, this may be done with the BUST card laid face up beneath the player's first cards) so that the player can still play against the dealer. If the dealer's total ends up as a non-bust hand (i.e., 17, 18, 19, 20 or 21) the dealer's hand wins against the player's BUST hand. However, if the player and the dealer both bust, the win may be based upon various sets of rules, such as the hand with the total closest to 21 wins, or the hand with the lowest BUST card (the last card received that broke the hand), or the hand with the largest BUST card wins between the player and the dealer. The variation is playable at a table or on a video blackjack machine.

The variation can be played with all the conventional rules of Blackjack (excluding the break or bust rules that immediately take a hand out of play when the hand busts), with certain rules being altered to account for the difference in house advantage. These certain rules would be selected from among the payouts on ties, splitting, doubling, the hitting of soft 17 and the payout on a Blackjack hand. The various rules may vary a) above a count of twenty-one for players and dealers, b) may vary for counts of twenty-one for one or both the player and dealer, and c) may vary for counts below twenty-one for one or both of the dealer and player (although it is most preferred to keep rules with counts of both players and dealer below a count of 21 or with only one or both player and dealer counts at 21, with variations with blackjacks consistent with standard Blackjack rules). Examples of the rules that may come into play during the No-Bust Twenty-One blackjack are those selected from among the group of:

1. the dealer may win all ties, including on Blackjacks, or
2. the player may win ties in Blackjacks, with or without payment of odds at 3:2, or
3. the dealer may win all ties, excluding Blackjack, or
4. the dealer may win all ties of 21 or under only, or
5. all tics would be a push (below, at or above a count of 21), or
6. the player could split any 2 cards of the same value, or
7. the player could split any 2 cards of the same value, except 10s, or 8. the player could split any 2 matching (6,6 and Q,Q, but not J,K) cards, or
9. the player could split only once, or
10. the player could split multiple times, or
11. the player could double on any 2 cards, or
12. the player could double only on certain 2 cards, or
13. the dealer may hit soft 17, or
14. the dealer may stand on soft 17, or
15. the player's Blackjack may pay up to 3-to-1, or
16. the player may insure his Blackjack for a percentage of the original wager, or
17. the insurance payout on the player's Blackjack would be less than the Blackjack payout (e.g., insurance is a payout of 2:1, while the payout on Blackjack may be 3:1 or 5:2).

The game may be generally described as a method of playing a wagering game with one or more standard decks of playing cards. Each deck preferably comprises a) 52 cards or b) 48 cards without 10's. The method comprises each player placing at least one wager to play in the game against a dealer; each player receiving two initial cards and the dealer receiving two initial cards; each player optionally exercising a right to take additional cards while the player's hand has a point count of 21 or below 21, each player having the option to exercise the optional right to take additional cards until a point count in a player's hand exceeds a point count of 21, the player's hand remaining in-play even after a point count in excess of 21 is obtained; the dealer taking hits according to conventional rules of blackjack so that the dealer total count according to the rules reaches at least a soft 17, at least a hard 17, or a count in excess of 21; and wherein, if both the player's hand and the dealer's hand exceed a point count total in excess of 21, rules determine whether the player's hand wins, ties or loses against the dealer's hand. The method preferably may be played with standard playing card decks of 52 cards, without jokers or wild cards. The dealer, according to preferred rules, must take hits with 16 or fewer points or a soft seventeen. Alternatively the dealer must take hits with 16 or fewer points and stay with a soft seventeen. The rules that determine whether a players hand wins, ties or loses with a count of both the player's hand and the dealer's hand above 21 may include that the player's hand wins when the player's hand count is closer to 21 then the dealer's hand count. Odds or bonuses may be paid according to the relative difference between 21 of the player's hand and the dealer's hand, or between point counts of the player's hand and the dealer's hand, an example of which is shown in U.S. Pat. No. 6,341,778. The rules that determine whether a players hand wins, ties or loses with a count of both the player's hand and the dealer's hand above 21 may include that the dealer wins when player's hand count and dealer's hand count are equal, or that the player wins when the player's hand count and the dealer's hand count are equal. Alternatively, or additionally, the rules that determine whether a players hand wins, ties or loses with a count of both the player's hand and the dealer's hand above 21 may include that the player and dealer tie when the player's hand count and the dealer's hand count are equal.

An alternative method of play provides rules that determine whether a players hand wins, ties or loses with a count of both the player's hand and the dealer's hand above 21 including that when both the player's hand and dealer's hand are equal in count, the hand that received the smaller value card to cause that hand to bust wins, or that the hand that received the larger value card to cause the hand to bust wins. Because of changes in other advantages and disadvantages in odds and house hold, it is an option for the player to receive in excess of 3:2 for a blackjack, e.g., 2:1, or 5:2 or 3:1. Other optional rules in the play of the game include the dealer winning all ties when both the player's hand and the dealer's hand are each above a count of 21, and wherein the player and the dealer tie when the point count of player's hand and dealer's hand are equal and over 21, or wherein less than all of the at least one wager is returned to the player when the point count of player's hand and dealer's hand are equal and over 21. It is possible to require that two equal wagers are placed at the beginning of the game and one wager is returned when the point count of player's hand and dealer's hand are equal and over 21, the wagers otherwise being treated as a single wager in the play of other elements of the game. There is little rational advantage for the player to take hits when the player's hand point count is twenty-one or higher (even doubling down), so the player should have the option of taking additional cards only when the player's total point count is less than 21. The player may double down on any first two cards in the player's hand, or even on any first three cards.

EXAMPLES

Examples of play of hands according to one variant of the play of No-Bust Blackjack according to the various rules available to play of the game would be as follows. Examples will be given that involve unusual events in the play of the game, with the standard rules of play for hand equal to or under counts of 21 remaining the same:

| Dealer's First Two Cards | Player First Two Cards |
|---|---|
| Example 1 | |
| 10 and 7 | 10 and 6 |
| Dealer Stands | Player hits with a 6 |
| Dealer stands and wins | Player busts and loses |
| Example 2 | |
| 10 and 6 | 10 and 6 |
| Dealer Hits with 6 | Player hits with a 6 |
| Dealer busts and ties | Player busts and ties or loses |
| Example 3 | |
| 10 and 3 | 10 and 4 |
| Dealer hits with 10 | Player hits with an 8 |
| Dealer busts and loses | Player busts and wins |
| Example 4 | |
| 10 and 5 | 10 and 6 |
| Dealer hits with a 7 | Player hits with a 9 |
| Dealer busts and wins | Player busts and loses |
| Example 5 | |
| 8 and 8 | 7 and 7 |
| Dealer hits with an 8 | Player hits with a 10 |
| Dealer busts and loses | Player busts and wins |
| Example 6 | |
| 8 and 8 | 7 and 7 |
| Dealer hits with a 6 (22) | Player splits, hits with a 10 and 8 |
| Dealer loses 1, wins 1 hand | Stays with 17, hits 15 with a 9 (24) |
| Example 7 | |
| Ace and 6 | 10 and 4 |
| Hits thrice with 6 and 3 and 7 | Hits with 9 |
| Player wins if player wins ties, player loses if ties go to dealer, ties if equal counts over 21 tie. | |

It is preferred that payouts for wins and losses remain as standard payouts, as opposed to payouts based upon the absolute difference between player hands and dealer hands (as taught in U.S. Pat. Nos. 6,296,251; 6,491,301; and 6,341,778), although side wagers may be used that incorporate multiple payouts or bonuses as are known in the blackjack and casino table game art. In a preferred method of play, the dealer would win all ties of 21 and under. Ties of Blackjack and hands of 22 and over would be a push. If the player and the dealer both go over 21 (with different point count hands), then the hand with a point count closer to 21 wins. The player's Blackjack would pay 5-to-2 or the player may opt to "insure" his Blackjack with an additional wager of 50% of the player's bet for an automatic 3-to-2 payout.

These and other aspects of the invention may be varied within the parameter of play described herein, using obvious or alternative game structures as are within the skill of the ordinary artisan in the table gaming industry. For example, with bonus events, bet sensors or bet acceptors may be used. With progressive jackpots, jackpot monitors may be provided. These changes and known variations in the play of blackjack-type wagering games are contemplated in the practice of this invention.

What is claimed:

1. A method of playing a casino table wagering game with one or more standard decks of playing cards, each deck comprising a) 52 cards or b) 48 cards without 10's, the method comprising:

each player placing at least one wager to play in the game against a dealer;

each player receiving two initial cards and the dealer receiving two initial cards;

each player having the option to exercise an optional right to take additional cards until a point count in a player's hand exceeds a point count of 21, the player's hand remaining in-play even after a point count in excess of 21 is obtained;

the dealer taking hits according to conventional rules of blackjack so that the dealer total count according to the rules reaches at least a soft 17, at least a hard 17, or a count in excess of 21;

wherein, if both the player's hand and the dealer's hand exceed a point count total in excess of 21, rules determine whether the player's hand wins, ties or loses against the dealer's hand.

2. The method of claim 1 wherein the game is played with standard playing card decks of 52 cards, without jokers or wild cards.

3. The method of claim 2 wherein the dealer must take hits with 16 or fewer points or a soft seventeen.

4. The method of claim 2 wherein the dealer must take hits with 16 or fewer points and stay with a soft seventeen.

5. The method of claim 2 wherein the rules that determine whether a players hand wins, ties or loses with a count of both the player's hand and the dealer's hand above 21 include that the player's hand wins when the player's hand count is closer to 21 then the dealer's hand count.

6. The method of claim 2 wherein the rules that determine whether a players hand wins, ties or loses with a count of both the player's hand and the dealer's hand above 21 include that the dealer wins when player's hand count and dealer's hand count are equal.

7. The method of claim 2 wherein the rules that determine whether a players hand wins, ties or loses with a count of both the player's hand and the dealer's hand above 21 include that the player wins when the player's hand count and the dealer's hand count are equal.

8. The method of claim 2 wherein the rules that determine whether a players hand wins, ties or loses with a count of both the player's hand and the dealer's hand above 21 include that the player and dealer tie when the player's hand count and the dealer's hand count are equal.

9. The method of claim 2 wherein the rules that determine whether a players hand wins, ties or loses with a count of both the player's hand and the dealer's hand above 21 include that when both the player's hand and dealer's hand are equal in count, the hand that received the larger value card to cause that hand to bust wins.

10. The method of claim 2 wherein the rules that determine whether a players hand wins, ties or loses with a count of both the player's hand and the dealer's hand above 21 include that when both the player's hand and dealer's hand are equal in count, the hand that received the smaller value card to cause that hand to bust wins.

11. The method of claim 2 wherein the player receives in excess of 3:2 for a blackjack.

12. The method of claim 2 wherein the dealer wins all ties when both the player's hand and the dealer's hand are each above a count of 21.

13. The method of claim 2 wherein the player and the dealer tie when the point count of player's hand and dealer's hand are equal and over 21.

14. The method of claim 1 wherein the player has the option of taking additional cards only when the player's total point count is less than 21.

15. The method of claim 14 wherein the player may double down on any first two cards in the player's hand.

16. The method of claim 14 wherein the player may double down on any first three cards in the player's hand.

17. The method of claim 1 wherein the player has the option to split two like-valued initial cards into two new hands.

18. The method of claim 1 wherein the player has the option to "surrender" his first two cards in return for 50% of the wager.

19. A method of playing a casino table wagering game with one or more standard decks of playing cards, each deck comprising standard playing card decks of 52 cards, without jokers or wild cards, the method comprising:

each player placing at least one wager to play in the game against a dealer;

each player receiving two initial cards and the dealer receiving two initial cards;

each player having the option to exercise an optional right to take additional cards until a point count in a player's hand exceeds a point count of 21, the player's hand remaining in-play even after a point count in excess of 21 is obtained;

the dealer taking hits according to conventional rules of blackjack so that the dealer total count according to the rules reaches at least a soft 17, at least a hard 17, or a count in excess of 21;

wherein, if both the player's hand and the dealer's hand exceed a point count total in excess of 21, rules determine whether the player's hand wins, ties or loses against the dealer's hand, wherein less than all of the at least one wager is returned to the player when the point count of player's hand and dealer's hand are equal and over 21.

20. The method of claim 19 wherein two equal wagers are placed at the beginning of the game and one wager is returned when the point count of player's hand and dealer's hand are equal and over 21.

* * * * *